United States Patent [19]

Trivelas et al.

[11] Patent Number: 4,896,577

[45] Date of Patent: Jan. 30, 1990

[54] ACTION FOR UPRIGHT PIANO

[76] Inventors: Chris A. Trivelas, P.O. Box 725, North Bend, Wash. 98045; Darrell G. Fandrich, 16611 NE. 20th, Bellevue, Wash. 98008

[21] Appl. No.: 104,277

[22] Filed: Oct. 2, 1987

[51] Int. Cl.[4] ..... G10C 3/18

[52] U.S. Cl. ..... 84/240; 84/247

[58] Field of Search ..... 84/236, 240, 239, 247, 84/253, 241, 242

[56] References Cited

U.S. PATENT DOCUMENTS

| | | | |
|---|---|---|---|
| 199,687 | 1/1878 | Brinsmead | 84/241 |
| 473,944 | 5/1892 | Merkel | 84/239 |
| 682,616 | 9/1901 | Herrburger | 84/241 |
| 788,482 | 4/1905 | Lingsch | 84/242 |
| 896,763 | 8/1905 | Schimmel | 84/240 |
| 1,000,762 | 8/1911 | Soper | 84/241 |
| 1,301,908 | 4/1919 | Clutsam | 84/240 |
| 1,866,152 | 7/1932 | Cameron, Jr. | 84/239 |
| 2,542,306 | 2/1951 | Brown | 84/240 |

FOREIGN PATENT DOCUMENTS

| | | | |
|---|---|---|---|
| 450378 | 3/1913 | France | 84/242 |
| 19278 | 12/1914 | France | 84/253 |
| 23539 | 10/1906 | United Kingdom | 84/236 |

*Primary Examiner*—L. T. Hix
*Assistant Examiner*—Brian W. Brown
*Attorney, Agent, or Firm*—Robert W. Jenny

[57] ABSTRACT

The subject action is a modification of the traditional upright action. The traditional jack spring is eliminated. Its function is assumed by a jack/repetition spring, which is a compression spring adjustably mounted between the jack near the end that engages the hammer butt and a pilot attached to the back stop portion of the hammer assembly. The hammer return spring mounting enables adjustment of the range of force applied by the spring to the hammer. The force range magnitude is such that the hammer return torque is commensurate to the torque that would be applied by gravity if the hammer shank were mounted horizontally instead of vertically. The operating force of the jack/repetition spring is related to that of the hammer return spring in such a way that re-engagement of the jack with the hammer butt is assured before hammer return beyond the back-checked point. The ends of the jack/repetition spring are geometrically located to allow the elements of the action to keep in intimate contact after re-engagement, making possible the elimination of the bridle tape and wire, and to provide a function that feels smooth and tight, not loose. The interaction between the springs as applied produces enough return force on the key to allow use of weights in the played end of the key to provide the desirable inertial resistance of a grand action to the player's touch on the keys. With the subject action properly adjusted, the hammer assembly rests upon the jack, rather than the traditional rest rail and therefore there is space between the hammer shank and hammer rest rail when the action is at rest.

4 Claims, 4 Drawing Sheets

(TRADITIONAL)

FIG. 3
PRIOR ART
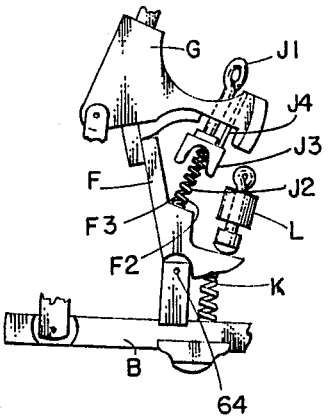
FIG. 4A
PRIOR ART
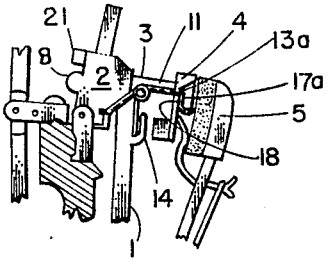
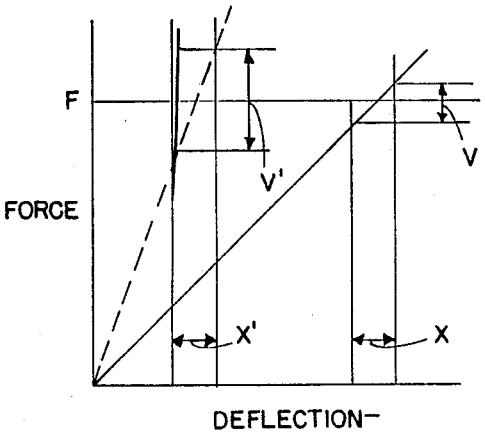
FIG. 5
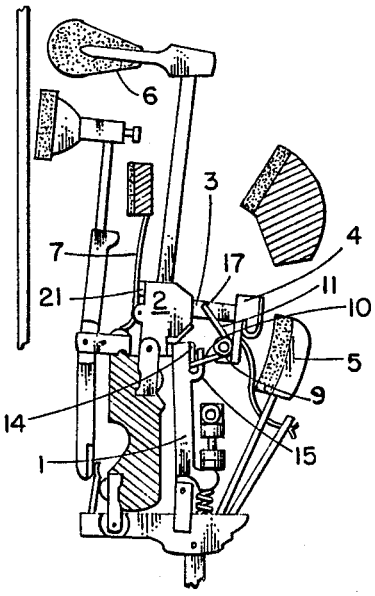
FIG. 4B
PRIOR ART FIG.8
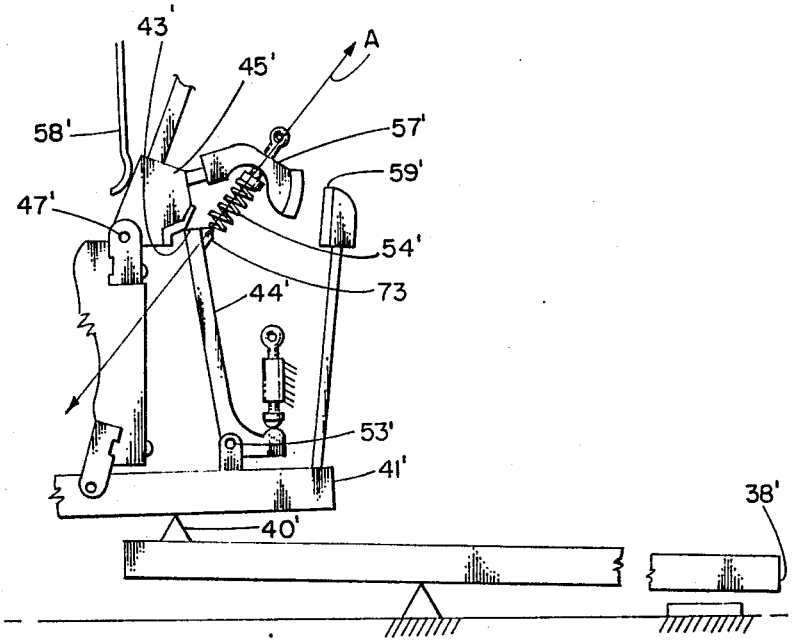
FIG.9A
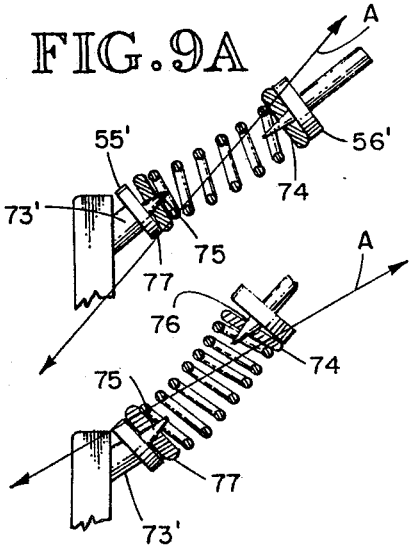
FIG.9C
FIG.9B
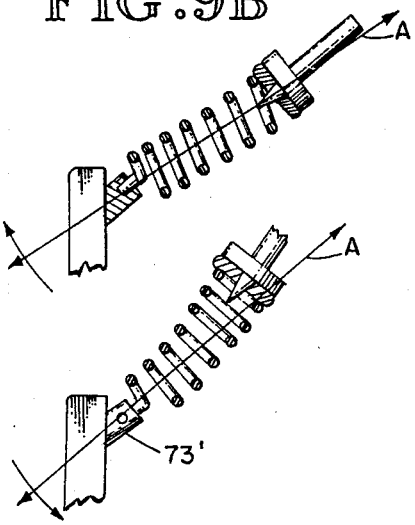
FIG.9D

ACTION FOR UPRIGHT PIANO

BACKGROUND OF THE INVENTION

FIELD: This invention is in the field of actions for pianos and specifically actions for upright pianos. More specifically, it is in the field of upright piano actions intended to provide, for upright pianos, playability similar to that of grand pianos.

PRIOR ART: It is well-known in the art that the "feel" or "playability" of grand pianos has been superior to that of upright pianos and, also, that grand pianos are considerably more expensive than uprights and require considerably more space. Therefore, in spite of the poorer playing capability of uprights, there has been and continues to be a market for them. Furthermore, there has been and continues to be a strong desire, if not need, for upright pianos with their cost and space saving advantage that have playing characteristics more like those of grand pianos.

U.S. Pat. No. 473,944 covers an upright piano action intended to rival grand piano actions in its playability. U.S. Pat. No. 896,763 covers an invention having a similar objective. U.S. Pat. Nos. 199,687, 682,616, 788,482, and 1,000,762 show other upright actions which were intended to emulate grand piano actions but were simpler and presumably less costly to manufacture and easier to maintain than those of U.S. Pat. Nos. 473,944 and 896,763. The action of U.S. Pat. No. 199,687 was manufactured for many years. (Note: there are additional specific references to prior art in the following Description of the Invention.)

Nevertheless, there is still no commercially available upright piano having playing characteristics approaching or equal to those of grand pianos. Yet it is logical to assume that the market for such a piano has increased significantly in recent years because of the increased value of space and the increased costs of pianos.

The failure of the prior art improvements to the traditional upright action to provide an upright piano action competitive with that of a grand piano can be attributed to at least three basic problems. The first is that in each case the added complications increase the costs enough to outweigh any commercial value of the improvements. The second is that the improved performance is achievable and achieved only when the action is finely adjusted and regulated, a condition which is difficult to attain and relatively difficult and expensive to maintain with the patented actions. Third, those adequately skilled in the art will recognize that the improvements disclosed in the prior art patents will not sufficiently affect the way the action feels and responds to a pianist to warrant the effort and expense of incorporating the improvements into the action.

In view of these problems, it is a primary objective of the subject invention to provide an upright piano action having playing characteristics rivaling those of a grand piano action. In particular, regarding playing characteristics, it is an objective to improve the repetition capability to the extent that a key can be reliably replayed when it is lifted only part way from the fully depressed position, as is possible with a grand action. Further, it is an objective that there be no discernable dynamic lost motion in the action. (Note: "dynamic lost motion," a term coined by the inventor for the functional characteristics which are the cause of the loose feel of the touch of the traditional upright action, will be defined in the Description of the Invention which follows.) Still further, it is an objective that the inertial characteristics of the actions do be commensurate with those of grand pianos. It is a further objective that these characteristics be attained without significant increases in the cost of the action due to increased complication or the like. Another objective is that the action be nearly as easy to adjust and maintain as the traditional upright action is and considerably easier than the traditional grand action. Another objective is that the action stay in adjustment at least as long as the traditional action.

SUMMARY OF THE INVENTION

The subject action can be effectively and clearly described by describing the difference between it and the traditional upright action, using the names and purposes of the structural and moving parts given in the book titled: *Piano Parts and Their Functions,* published by the Piano Technicians Guild, Inc., P.O. Box 1813, Seattle, Wash. 98111, Copyright 1981, Library of Congress Catalog Card No.: 80-83705.

There are three essential differences. First, the jack spring has been eliminated. In the traditional action, the jack spring is a short, conical compression spring located between the short arm or toe of the jack and the wippen. In the subject action, the function of the jack spring is provided by a jack/repetition spring located between a point near the top of the jack and the backstop shank/backstop assembly. The backstop shank/backstop assembly is modified in detail to accommodate the jack/repetition spring. In the subject invention, an additional function of the jack repetition spring is to support the hammer assembly during the re-engagement of the jack so that a replay capability is present before the hammer returns beyond the backchecked position during the return motion of the action to the at-rest position.

Second, whereas the hammer spring in the traditional action can be adjusted only by manual deformation of the spring, the subject action incorporates a screw for adjusting the range of the force applied by the spring. Also, for reasons noted later, the spring is stronger, i.e. applies more force than that of the traditional action. The force applied by the spring at its point of contact with the hammer butt, acting about the hammer center, produces torque in the range of that which would be produced by the force of gravity on the hammer if the hammer were positioned with the hammer shank essentially horizontal, as in a grand action.

Third, any weights used in the keys of the traditional action are (except in rare instances) located in the non-playing end, the end not touched by the player. In the subject action, the weight(s) is/are located in the played/player end of the key, again as in a grand action.

Some apparent precedent was found in the search of the prior art for the first difference. U.S. Pat. Nos. 1,000,762 and 1,301,908 show springs between the jack (assembly) and the backstop shank/backstop assembly. In both patents the traditional jack spring is retained. In U.S. Pat. No. 1,301,908 the spring J contacts the jack assembly about midway between the jack center and the end of the jack and its line of action crosses or passes the jack center when the key is depressed. The significance of this characteristic will become apparent in the description which follows.

In U.S. Pat. No. 1,000,762 the spring between the end of the jack and the backstop assembly is similar to a safety pin spring and tends to aid in moving the hammer toward the strings as in a striking motion. This tendency is in accordance with the objective stated in the patent of allowing the action to be played with a lighter touch. In the embodiment shown in FIG. 5 of that patent the spring also tends, at its other end, to re-engage the jack with the hammer butt, aiding in achieving the stated objective of quicker repetition capability. There is no adjustment for this spring except by manually deforming it.

It will be understood by those skilled in the art that the three modifications to the traditional action as described will, in combination, enable achieving the objectives of the subject invention, whereas the cited prior art modifications, individually or in combination, did not and could not meet these objectives. The subject action has playing characteristics that rival those of grand pianos. The combination of the stronger hammer return spring, the strength and effectiveness of the jack-/repetition spring and the weights in the player ends of the keys enable re-engagement of the jack with the hammer butt when the key is raised less than one-half the distance between its fully depressed position and at-rest position on the return stroke as is the case for the grand piano action. The traditional upright action will also re-engage at ½ stroke, but only provided the key is allowed to return at full speed. A key return at less than full speed will likely require return to at-rest position for re-engagement to occur reliably. The weights in the player ends of the keys provide key inertia comparable to that of grand action keys. Addition of complication is minimal since the traditional jack spring is replaced by the jack/repetition spring and the adjustment of the hammer return spring is a simple adjustment screw. This screw provides return adjustment capability which is easier than that of traditional actions and/or not available in traditional actions. The higher force levels used with the modifications and the simplicity and robustness of the embodiments make for easier, not delicate, adjustability and for long term stability of the adjustments.

The combination of the stronger hammer return spring, the strength and effectiveness of the jack/repetition spring and the weighted player ends of the keys enable the subject action to have playing characteristics that rival those of a grand. The inertial characteristics of grand piano actions derive from the weights in playing ends of the keys and the distribution of masses, including those of the weights, in combination with leverages as affected by fulcrum locations, with a most important factor being the upward force at the capstan, the fulcrum under the wippen. Regarding inertial characteristics, it is understood by those skilled in the art that because the hammers of a piano are graduated in size and mass, being larger and heavier in the bass, and because the hammer return springs of the subject action are adjusted to provide hammer return force and torque commensurate with those produced by gravity with the hammer shank horizontal, it follows that, for a standard touch weight, counterbalancing weighting in the keys will be graduated, being heaviest in the base, as it is in grand actions. The inertial characteristics of a grand action derive primarily from the weights in the player ends of the keys that assist in the depression of the key for slow, pianissimo play but inertially impede key depression for fast, forte play, making possible the highly desired linear relationship between the force applied to a key and the resulting perceived volume of tone. Weighting the player ends of the keys is made possible in the subject action by the stronger, gravity force level hammer return spring, which in turn is made possible by the capability of the jack/repetition spring to precisely oppose these forces for the re-engagement of the jack. The fact that repetition of the subject action is nearly identical with that of a grand action is attributable in part to the jack/repetition spring performing a nearly identical function as the grand repetition spring/ lever.

The efficiency of the jack/repetition spring is such that it interrupts the opposed forces of the hammer return spring and weighted player end key only enough for the re-engagement of the jack with the hammer butt, after which the effect of the jack/repetition spring is essentially nil. This effective absence of separation force allows the strong hammer return spring to react with the key weight and inertia to keep the jack in intimate contact with the hammer butt during hammer return. It is this contact that eliminates the dynamic lost motion that plagues the traditional action with a loose disjointed feel during various types of repeated play. Elimination of dynamic lost motion makes possible the elimination of the bridle tape and wire, as explained later. Thus, the additional complication of one screw adjustment in the subject action is minimized by the elimination of the traditional jack spring, bridle tape and wire.

BRIEF DESCRIPTION OF THE DRAWINGS

FIG. 3 is a reproduction of FIG. 4 of U.S. Pat. No. 1,301,908.

FIG. 4A is a reproduction of FIG. 5 of U.S. Pat. No. 1,000,762.

FIG. 4B is a reproduction of FIG. 2 of U.S. Pat. No. 1,000,762.

FIG. 5 is a graphic illustration of the characteristics of springs, particularly spring rate and ratio of total deflection to working deflection.

FIG. 8 is a schematic view of the action of FIG. 6 at the instant of useful re-engagement of the jack with the hammer butt.

FIGS. 9A, 9B, 9C, and 9D illustrate the details and effects of the details of the alternate repetion spring installation.

DETAILED DESCRIPTION OF THE INVENTION

For purposes of this description it will be understood that the action of a piano is not a self contained subassembly. Instead, it is built into the piano with various elements attached in some way to various structural elements of the piano. In this description such structure is referred to as basic structure.

Figure 1:
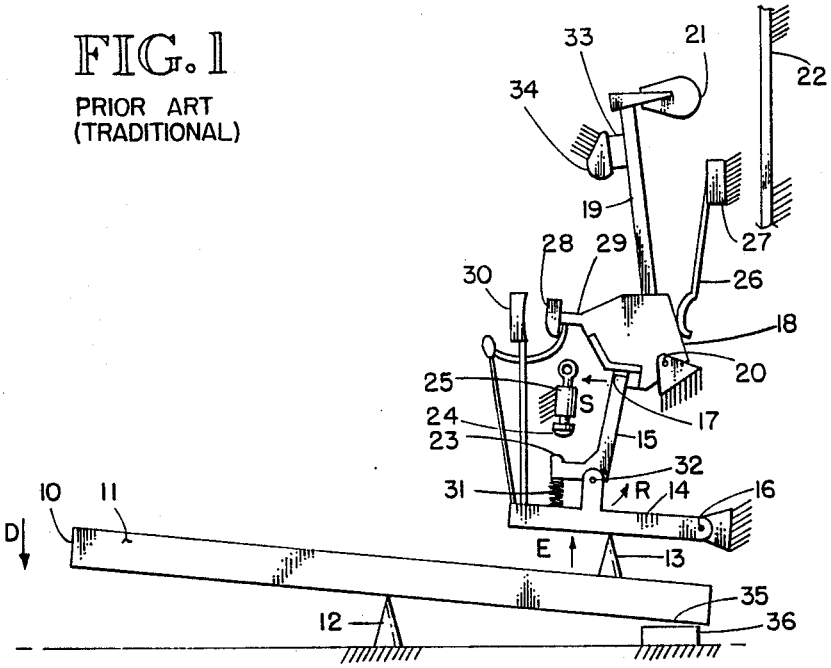
FIG. 1 PRIOR ART
FIG. 1 is a schematic diagram of a traditional upright action in the at-rest position.

Referring to FIG. 1, a schematic diagram of a traditional upright action, a note is played by movement of end 10 of key 11 in the direction indicated by arrow D. The key rocks on fulcrum 12 (attached to the basic structure of the piano) so that fulcrum 13 moves in the direction by arrow E. Fulcrum 13 raises wippen 14 and thereby jack 15, the wippen pivoting about its center 16.

End 17 of the jack, engaged with butt 18 of hammer assembly 19 rotates the hammer assembly about its center 20 (attached to the basic structure), so that head 21 of the hammer is set into motion toward string(s) 22. As the motion continues, toe 23 of the jack approaches button 24, adjustably mounted on rail 25 (attached to basic structure). Upon contact with button 24, continued motion of the wippen causes the jack to rotate in the direction indicated by arrow R. This rotation causes jack end 17 to move in the direction indicted by arrow S, thus to disengage from butt 18. This disengagement, also termed escapement, occurs just before the head 21 strikes the string(s). The momentum of the hammer causes the head to strike the string(s) and then rebound. Hammer return spring 26, attached to spring rail 27 (attached to basic structure), supplements this rebound. At some point backstop 28 of backstop assembly 29 will contact back-check block 30 to stop the hammer motion. This completes the striking of a note.

To prepare for repetition, or to repeat the striking of the note, the playing end 10 of key 11 is released to move in the direction opposite that indicated by arrow D. This allows fulcrum 13 to move in the direction opposite that indicated by arrow E under the force of gravity acting on the portion of the key beyond the fulcrum 12 from the played end (i.e. the working end) and on the masses of the components fully and partially supported on fulcrum 13 and aided by jack spring 31, the compression of which is relieved by the return motion of wippen 14. At some point in the process of resetting the action for repetition of the playing of a note, end 17 of jack 15 will become clear of butt 18 and jack spring 31 will rotate the jack about jack center 32 in a direction opposite to that indicated by arrow R and re-engage the jack with the butt. At that point another note can be played by depressing the playing end of the key.

In the traditional action this point occurs somewhere between the point of key release, with the hammer in the checked position having completed about $\frac{1}{3}$ of its return and the point where the action has reached its at-rest position, determined by contact between the underside of the working end of the key 35 and the felt pad 36 (attached to the basic structure) and contact between hammer assembly 19 and hammer railcloth 33 on hammer rest rail 34 (attached to the basic structure). The precise point of re-engagement of the jack with the hammer butt will be determined by the acceleration differential that exists, or is allowed by the pianist, between the hammer assembly 19 and the jack 15. If the releasing motion is sufficiently swift, so as to allow the action to return at a rate limited only by the built-in forces of the springs, inertia and gravity, re-engagement may occur almost immediately, possibly even before the hammer has reached the halfway point between the strings and its at-rest position. This is possible because the ratio of return force to inertia for the key/wippen/-jack to that for the hammer assembly is considerably greater in the traditional action than that in the subject action. The ratio is improved in the subject action because of the increase in the ratio of return force to inertia in the hammer assembly. This will be further evident in a comparison of the movements of the two assemblies in achieving unimpeded re-engagement from the checked position expressed as fractions of their total possible movement. The leverage of the traditional upright action is such that the key/wippen/jack assembly moves through about $\frac{2}{3}$ of its working travel to bring the hammer assembly from at-rest position to the point of letoff, nearly against the string. The remaining $\frac{1}{3}$ achieves escapement. Therefore the key/wippen/jack assembly will be about $\frac{1}{3}$ depressed from the at-rest position, or about $\frac{2}{3}$ returned from the fully depressed position, when the hammer is at the midpoint of its working travel with the jack engaged with the hammer butt. The key/wippen/jack will thus have moved through $\frac{2}{3}$ of its working travel for the unimpeded action to have achieved re-engagement at the midpoint of the hammer return. Compare this $\frac{2}{3}$ movement with the 1/6 working travel movement of the hammer from the checked position of $\frac{1}{3}$ return to the midpoint. The key/-wippen/jack assembly obviously will have moved considerably more swiftly than the hammer assembly in their respective movements toward their at-rest positions, which leads to the phenomenon of dynamic lost motion. In the traditional upright action, the capstan screw (fulcrum 13), upon which the wippen 14 and jack 15 rest, is adjusted so as to provide a small clearance space between the end of the jack 17 and its point of contact with hammer butt 18. With this small clearance space, the jack can easily re-engage the hammer butt when the at-rest position has been reached after a key releasing motion which was too slow to allow the key/-wippen/ jack assembly an earlier opportunity to reach a position favorable for re-engagement by virtue of its ability to out-accelerate the hammer butt assembly. When a key is struck, the initial movement of the key/-wippen/ jack assembly will be to close this small clearance space or gap. This is "lost motion" because the hammer has yet to move. The term dynamic lost motion has been coined for the gap which occurs at the same place but which is usually much larger and results after the key/wippen/jack assembly, out-accelerating the hammer butt assembly, achieves re-engagement and continues on toward the at-rest position, leaving behind the hammer butt assembly which will catch up momentarily. However, if the key is now restruck, before the hammer butt assembly has caught up, the initial movement of the key/wippen/jack assembly will again be to close the gap to make contact with the hammer butt assembly (dynamic lost motion). However, this gap is usally so large that the pianist feels the shift, with a jolt, of the lighter touch as the action closes the gap to the normal touch as the accelerating key/wippen/jack assembly first collides with and then begins to move the hammer butt assembly. The considerable wear on the pads on the hammer butt associated with dynamic lost motion is alleviated by the reduction of dynamic lost motion.

Figure 2:
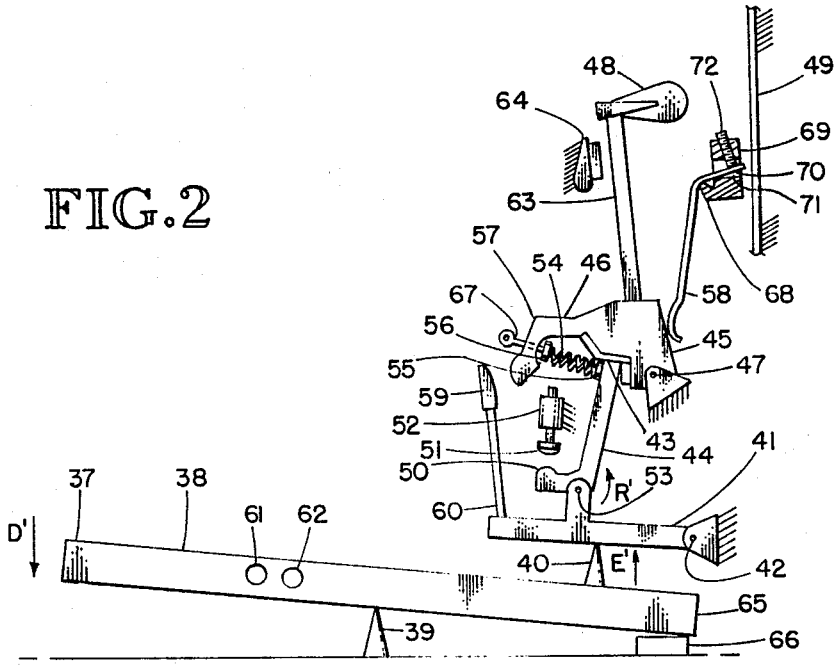
FIG. 2 is a schematic partially sectioned diagram of an upright action in the at-rest position and incorporating the modifications which implement the subject invention.

Referring to FIG. 2, a schematic diagram of an upright action in the at-rest condition and incorporating the modifications which implement the subject invention, a note is struck by depressing end 37 of key 38 in direction arrow D'. The key rocks on fulcrum 39 (attached to basic structure) and fulcrum 40 is moved in the direction of arrow E'. Fulcrum 40 rotates wippen assembly 41 about its center 42 so that end 43 of jack 44, supported on the wippen assembly, rotates butt 45 of hammer assembly 46 about hammer center 47 (attached to basic structure) and imparts motion to the hammer assembly such that head 48 moves to strike string(s) 49. Before the hammer strikes the string(s) toe 50 of the jack engages regulating button 51 adjustably mounted on regulating rail 52 (attached to basic structure). This engagement and continued motion of the wippen assembly causes the jack to rotate in the direction of arrow R' about jack center 53 so that end 43 disengages from butt 45. The disengagement motion compresses jack/repetition spring 54, the spring being engaged at one of its ends on pilot 55 on the jack near end 43 of the jack and at its other end on pilot 56. Pilot 56 is adjustably supported from back stop assembly 57 which is integral with butt 45. It would be possible to support pilot 56 from he hammer butt by structure independent of the back stop assembly and therefore, for breadth of the disclosure, it is stated that pilot 56 is structurally supported from the hammer butt. After the disengagement of the jack from the hammer butt, the momentum of the hammer assembly sustains the hammer motion to complete the strike. The hammer rebounds from the string(s), abetted by the force of return spring 58. The hammer rebound is checked by back stop assembly 57 engaging back-check block 59, supported from the wippen by back-check wire 60.

The inertia of the key/wippen/jack assembly, the strong hammer return force and the absence of separation between the hammer assembly and key/wippen/-jack assembly except during re-engagement inhibit involuntary restrike. It will be recognized that these are the same characteristics that serve to eliminate dynamic lost motion.

To prepare for repetition the played end of the key is released so that it begins to move (return) in the direction opposite to that of arrow D′ and back check block 59 moves away from back stop assembly 57, to allow return motion of the hammer. Correspondingly, fulcrum 40 begins to move in the direction opposite that of arrow E′. This motion is caused by the forces of gravity acting on the masses of the elements of the action and abetted by the hammer return spring force acting through the hammer/back-stop assembly, the jack-/repetition spring, the jack and wippen and fulcrum 40.

In this function the force of the hammer return spring acts analogically to the force of gravity on the elements of a grand action. The torque level produced by the force applied by the return spring 58 to butt 45 is designed and adjusted to be commensurate with the torque that would be produced by the force of gravity on the hammer with the hammer shank essentially horizontal. The force of the jack/repetition spring is directed and adjusted relative to that of the hammer return spring so that the jack/repetition spring can achieve jack re-engagement with the hammer butt for a restrike by the time the played end of the key has moved ½ the distance from its depressed position to its at-rest position.

In both the traditional upright and grand actions effective re-engagement can occur by the time the key has returned halfway from the fully depressed to the at-rest position. Re-engagement may occur in a grand action when the key has returned as little as one-third the way from fully depressed to the at-rest position. However, such re-engagement is not fully effective. In practical terms, key return of between ⅓ and ½ is necessary for a musically useful restrike. The subject invention equals the grand in this ability. The traditional upright action requires unimpeded key return to accomplish restrike at ½ key return. That grand piano actions are regarded as being capable of reliable repetition at significantly less than ½ key return is due to a capability to restrike with only partial jack re-engagement. The subject action equals or exceeds the grand action's partial jack re-engagement repetition capability.

It has been determined during development and testing of the subject action that, with the preferred embodiment of the jack/repetition spring and its installation, marginally acceptable performance is attainable with the hammer return torque as low as 50% of that provided by gravity with the hammer shank horizontal, provided that the ratio of the distance from fulcrum 39 in FIG. 2 to end 37 is 1 to 2 times the distance from fulcrum 39 to fulcrum 40. Addition of some weight to the played end of the key assists this attainment with weight being more necessary with lower ratios. The distance from fulcrum 39 to end 37 is termed the played end length; the distance from fulcrum 30 to 40 is termed the working end length.

Defining the optimum combination of this ratio, hammer return spring effectiveness and key weighting, relative to jack/repetition spring performance, is a matter of optimizing action performance for peak performance or, in some cases, optimum performance relative to production and maintenance factors, including costs.

The strength of the jack/repetition spring, along with its orientation, enables it to support the hammer against the force of the return spring until the jack re-engages the hammer butt. The re-engagement is aided by camming action between the end of the jack and the hammer butt surface it contacts.

At this point there are three torques applied to the hammer butt: the torque caused by the hammer return spring, the torque caused by the force of the jack/repetition spring on the back-stop assembly and the torque caused by the camming force of the jack. The value of the torque caused by the jack/repetition spring on the back-stop is nearly equal to the value of the torque caused by the hammer return spring. Therefore, at this point, unless the key return is somehow impeded, the torque on the hammer butt caused by the return spring is being opposed primarily by the torque caused by the jack/repetition spring. The magnitude of the force delivered by the spring is determined largely by the reaction force available at the jack center. This reaction force is generated by the acceleration of the masses of the jack, the wippen assembly and the key. The addition of weights 61 and 62, for example, to the key adds appreciably to the mass, and therefore to the available reaction force, the force applied by the jack/repetition spring and the torque produced by that force on the hammer butt. This torque is such that the hammer return is delayed by it until re-engagement is complete or well underway. There are two results of this delay. First, a note can be repeated at this point in the process and, second, the hammer shank 63 does not need to contact the rest rail 64 when the action is at rest. Instead, as it does in grand actions, the at-rest position of the hammer is determined by the position of the hammer butt, the jack, the wippen, fulcrum 40, the working end of key 65, pad 66 and the basic structure to which it is attached.

Also, during re-engagement of the jack end with the hammer butt, the jack end moves closer to the hammer center, reducing the leverage of the force from the jack with the hammer butt. Also, as the engagement proceeds, the jack/repetition spring extends and its force lessens accordingly and the direction of the force changes. The torque produced by the hammer return spring becomes dominant and the action reaches its at-rest condition unless a note is struck before the at-rest condition is reached.

The weights in the playing end of the key serve the purpose as described and also add the desired inertial touch characteristic, comparable to that of the keys of grand pianos.

The strong springs required for operation as described are definitely more robust than those found in traditional actions. These higher spring force levels lessen the effects of friction in centers (pivots) and keys. Such friction effects are a common cause of malfunction.

As previously noted, the strong springs and their interaction ensure that the dynamic lost motion, a term coined by the inventor, is virtually eliminated. In the traditional action, FIG. 1, re-engagement of the jack with the hammer butt requires that the jack, wippen, etc. fall faster, when the key is released to return toward its at-rest position, than the hammer assembly, so that the jack spring can move the end of the jack under the butt. However, the action is set up so that re-engagement will occur even if the wippen, jack, etc. do not fall enough faster than the hammer assembly falls (returns). The set up is such that, when the hammer has returned to rest against rail cloth 33 and the key is in its at-rest position, there is a gap between the end 17 of the jack and the hammer butt 18. This gap assures that the jack can re-engage the butt. The motion to close this gap when a note is struck is termed the lost motion. Since this gap occurs when the action is at rest, the motion to close the gap can be termed static lost motion. However, when a piano is being played, sufficient gap occurs to allow re-engagement while the action is in motion and neither the hammer or key is in an at-rest position. The motion to close the gap to strike another note while the action is in motion is termed dynamic lost motion, as previously described. It has been found that in the subject action, with the keys weighted as desired, and with optimum relative adjustment of the hammer return spring and jack/repetition spring, dynamic lost motion is virtually eliminated, rivaling and even surpassing grand piano action in that respect. Dynamic lost motion is the cause for what musicians call the loose feel of upright actions. Such loose feel is undesirable.

To make return spring 58 adjustable, it is mounted on a fulcrum 68 on spring rail 69 and provided with an extension 70 beyond the fulcrum. The extension fits in slot 71 in the rail and is engaged by screw 72 which is threaded into the rail, lies in the plane of the spring and has its turning axis essentially normal to the extension. Turning this screw into the rail increases the force exerted by the spring on the hammer butt and vice versa.

To explain this piano action in further detail, since the force provided by the hammer return spring simulates the force provided by gravity on the hammer in a grand action and the effects of the force of gravity on the grand action hammer do not vary appreciably throughout the excursion of the hammer, it is important that the effects of the force provided by the hammer return spring in the subject action not vary appreciably throughout the excursion of the hammer. This is accomplished by having the working deflection of the spring be a small fraction of the total deflection of the spring. The working deflection is the distance the end of the spring in contact with the butt moves during the motion of the hammer butt. The total deflection is the distance the end of the spring must be moved from its free position during installation to its most compressed installed position.

FIG. 5 illustrates this point in graphic form. In the graph the ordinate represents spring force and the abscissa spring deflection. The value F on the ordinate represents the desired force to be provided by the return spring when installed. The solid line represents the force versus deflection of a spring having a relatively low spring rate and a relatively high ratio of total deflection to working deflection. The dashed line represents the force versus deflection of a spring having a relatively high spring rate and a relatively low ratio of total deflection to working deflection.

The equal distances X and X' represent the working deflection for each spring. Note that the force variation V for the solid line spring is considerably less than V', the variation for the dashed line spring.

It can be seen, further, that the force variation would be less for smaller working deflections. The working deflection can be made less by using a still stronger spring and arranging for the point of engagement of the spring on the butt to be closer to the hammer center. With the distance from the point of contact to the hammer center small, it becomes difficult, if not impossible, to manufacture the spring to produce force in the desired range when installed. Therefore, it becomes economically imperative to make the spring installation adjustable.

The installation and functional conditions for the jack/repetition spring are similar to those for the hammer return spring except that the working deflection is relatively large and not as subject to design control since the jack must move specific amounts to satisfactorily engage and disengage. Therefore, for the jack/repetition spring it is essential that the spring be such that the ratio of total deflection to working deflection can be relatively large even with the required working deflection. A coiled compression spring, suitably mounted at each end, most readily meets these requirements.

Figure 6:
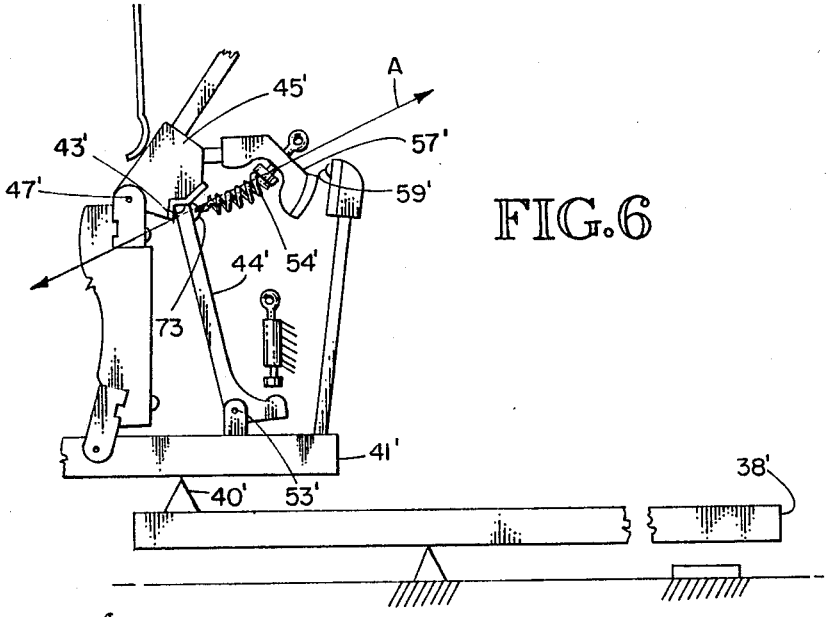
FIG. 6 is a schematic view of the subject action in the at-rest position with alternate jack/repetition spring installation details.
Figure 7:
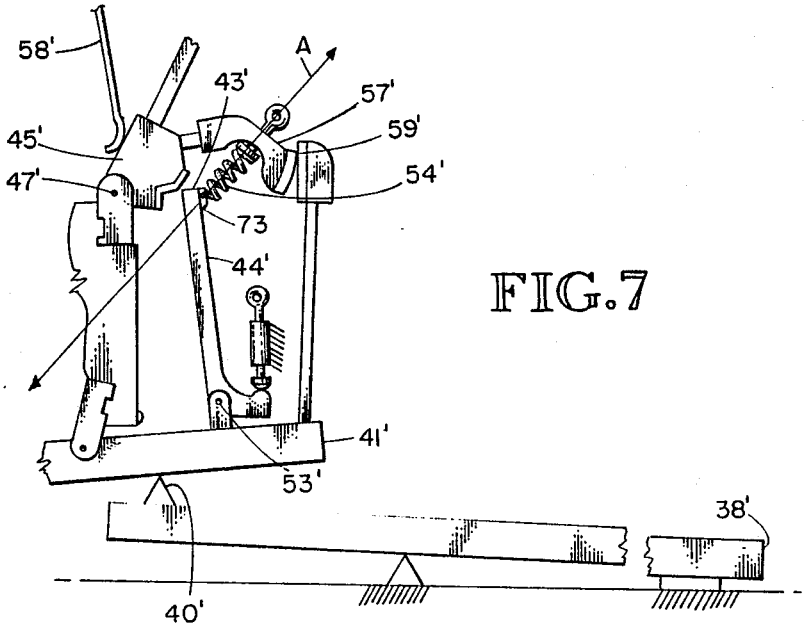
FIG. 7 is a schematic view of the action of FIG. 6 in the back-check position.

FIGS. 6, 7, 8, and illustrate, schematically, alternate installation details of the jack repetition spring in the subject action and the effects of the details. The parts are numbered as in FIGS. 1 and 2 but with the numbers primed.

In FIG. 6 the action is in the at-rest condition. In this condition the line of action of the jack/repetition spring 54', indicated by arrow A, intersects a line between hammer center 47' and jack center 53' at a point close to the hammer center, providing the jack/repetition spring a relatively small lever arm about the hammer center. In FIG. 7, in which the action is shown in the back-check condition, the line of action, indicated by arrow A', intersects the line between hammer center 47' and jack center 53' at a point approximately half way between the centers, providing the jack/repetition spring a relatively large lever arm about the hammer center while maintaining an ample lever arm about the jack center. The significance of the alignments of the line of action is discussed further later. The difference in the alignments in the two conditions is provided by the geometric details of the parts and the details of the installation of the jack/repetition spring. It is possible that the geometry could be arranged so that the line of action in the at-rest condition passes above the hammer center so that the jack/repetition spring force supplements the hammer return spring action. More practically, the torque produced on the hammer assembly about the hammer center by the jack/repetition spring for the at-rest condition may be made close to zero so that the torque for the at-rest condition is a percentage of the torque in the back check condition. The percentage may be in the range of 0 to 60%. To describe the operation and characteristics of the action further, when the played end 38' of the key is allowed to move from the fully depressed position shown in FIG. 7 to a position approximately midway between the fully depressed position and the at-rest position, FIG. 6, the jack and wippen 41' follow the fulcrum 40' under the force of gravity on the jack and wippen and under the force of the jack/repetition spring 54' and back check 59' disengages from back stop assembly 57'. The force in the spring, in combination with the lever arm provided for it by the line of action indicated by arrow A' in FIG. 7, applies a torque to the hammer assembly in the strike direction. The adjustable hammer return spring and adjustable jack/repetition spring are designed and adjusted so that the torque applied by the jack/repetition spring is approximately equal to the torque applied by hammer return spring 58' in the return direction. As a result, the hammer assembly is held virtually motionless while the jack end 43' is moved by the jack/repetition spring into re-engagement with the hammer butt 45'. As the jack moves, the effective lever arms of the jack-/repetition spring about the jack and hammer centers change, the lever arm affecting the jack increasing and that affecting the hammer assembly decreasing. As a result, if the key is allowed to continue to move toward the at-rest position, re-engagement continues and the hammer assembly returns to its at-rest position. However, with the action in the status shown in FIG. 8, with the played end of the key no more than half-way to its at-rest position, engagement between the jack and hammer butt is fully effective and immediate restrike is possible. To this point, the working of the action as described is the same as for the embodiment shown in FIG. 2.

With the subject invention described to this extent, the closer prior art can be discussed in better perspective.

Regarding U.S. Pat. No. 1,301,908, the specification describes the action and the functions of its parts but does not make clear what effects the invention is intended to have on the playing characteristics of a piano. The embodiment shown in FIG. 4 of that patent (FIG. 3 in this application) bears a closer resemblance to the subject apparatus than the other embodiments in the patent. A major difference between that embodiment and the subject apparatus is that the direction of force of spring $J_2$ in the patented apparatus passes on one side (the left side in this view) of the jack center 64 (number added for purposes of this application) when the jack F is engaged with butt G and on the other side when the jack is disengaged and the hammer in the striking position range. In one case it assists jack spring K, in the other it opposes it. It can be concluded that this function will tend to retard both the hammer return and jack re-engagement, in turn tending to decrease the rate of repeatability and increase dynamic lost motion, both counter to the objectives of the subject invention.

U.S. Pat. No. 788,482 discloses an upright action intended to rival grand piano actions in terms of repeatability. The traditional jack spring is eliminated and its functions served by a spring operating between the hammer engaging end of the jack and the back stop assembly. However, the line of action of that spring is consistently close to the hammer center so that, unlike the equivalent spring in the subject action, it does not serve to oppose the action of the hammer return spring to facilitate effective re-engagement of the jack with the hammer butt.

Regarding U.S. Pat. No. 1,000,762, FIG. 5 of which is reproduced as FIG. 4A of this application and FIG. 2 as FIG. 4B, the objectives include achieving the capability to strike notes with a lighter touch by the player and "to insure a positive repeating and more rapid movement than has been heretofore attained." These objectives are said to be achieved by adding spring 11 (number added in FIG. 4A for purposes of this application) and cushion 21, FIG. 4B. Cushion 21 contacts the return spring 7 (FIG. 5) as the hammer nears contact with the string(s) and, in effect, increases the spring rate of spring 7 for the final part of the hammer travel to the string(s). This is intended to cause more rapid rebound of the hammer.

Spring 11 applies a force at 13$^a$, opposing the function of spring 7 and of pad 21 and acts as a resilient extension of the jack, tending to urge the hammer in the striking direction. End 14 (FIG. 4B) of spring 11 tends to re-engage the jack and butt as soon as clearance permits. There are no adjustment means on either spring 7 or spring 11. The traditional jack spring (FIG. 4B and not numbered) is retained. It can be concluded from consideration of these observations that the action of U.S. Pat. No. 1,000,672 would allow a lighter touch and have good repeatability characteristics but at the expense of severe dynamic lost motion and considerable difficulty in achieving and maintaining the necessary relationships of the forces of the hammer return spring 7, spring 11 and the jack spring. The objectives of the subject invention could not be met and this may in part account for the fact that the action of U.S. Pat. No. 1,000,762 is not known to have achieved commercial success.

By contrast, it can be understood that the subject invention fulfills its objectives. The repetition capability is such that a key can be replayed when it has moved less than one-half the distance from its depressed position to its at-rest position. This can occur because the hammer's return is opposed at the check position by the force from the jack/repetition spring and the camming action of the jack until the jack is re-engaged with the hammer butt. The keys have inertia comparable to that of the keys of grand piano actions, the weights which augment the inertia helping to minimize or eliminate dynamic lost motion. The functional objectives are achieved with the minor mechanical complication of the addition two adjustment screws and the replacement of the traditional jack return spring with the jack-/repetition spring. The added adjustability features make it more adjustable and more easily adjustable than the traditional action. The robustness of the springs augments the ease of adjustment and enhances assurance that the adjustments will endure.

While preferred embodiments of the invention are described herein, it will be recognized by those skilled in the art that other embodiments and modifications of those described are possible within the scope of the invention which is limited only by the appended claims.

What is claimed is:

1. An action for an upright piano, said piano having a basic structure, said action comprising a plurality of key-hammer mechanisms and having an at rest position, said key-hammer mechanisms individually comprising:

a key having a playing end, a working end, a first fulcrum attached to said basic structure and supporting said key between said playing end and said working end, at least one weight installed between said playing end and said first fulcrum, and a second fulcrum attached to said key between said working end and said first fulcrum, a wippen having a wippen center, a jack center, a jack having a toe and an engaging end, said jack being pivoted at said jack center, a backcheck wire, a backcheck block attached to said wippen by said backcheck wire, said wippen being pivoted to said basic structure at said wippen center and supported by said second fulcrum, a hammer assembly having a hammer butt, a backstop assembly, a hammer shank and a hammer head, said hammer butt being pivoted to said basic structure at a hammer center, said piano having at least one string attached to said basic structure and positioned to be struck by said hammer head, a regulating button attached to said basic structure, a hammer return spring, supported between said basic structure and said hammer assembly, producing a first force and engaging said hammer assembly at a lever arm distance from said hammer center such that said first force produces a first torque on said hammer assembly in a direction to urge said hammer head away from said at least one string, said first torque being in the range of 25% to 150% of the torque which the force of gravity would produce on said hammer assembly about said hammer center with said hammer shank essentially horizontal, said at least one weight producing a second force due to the force of gravity on said weight, said second force being applied to said hammer assembly by said engaging end of said jack, via said wippen and said first fulcrum, at a lever arm distance from said hammer center such that said second force produces a second torque on said hammer assembly opposing said first torque, a repetition spring having first and second ends and producing a third force, said ends being supported between a first point on said hammer assembly and a second point on said jack, said first and second points having an arrangement, said arrangement determining the line of action of said third force, said line of action oriented to urge engagement of said engaging end of said jack with said hammer butt, said line of action also oriented to provide a lever arm distance for said third force about said hammer center such that said third force produces a third torque on said hammer assembly, said third torque also opposing said first torque, said hammer butt having a shape such that engagement of said engaging end of said jack with said hammer butt has a camming action which produces a fourth force on said hammer butt at a lever arm distance from said hammer center such that said fourth force produces a fourth torque on said hammer assembly, said fourth torque also opposing said first torque, said second force being such that, with said engaging end of said jack being engaged with said hammer butt, the sum of said second, third and fourth torques is less than said first torque such that said first torque, via said hammer butt, said wippen and said first fulcrum, produces a net return force urging return of said playing end of said key toward said at-rest position, said arrangement and said shape being such that, with said engaging end of said jack being disengaged from said hammer butt, said sum of said second, third and fourth torques is greater than said first torque such that re-engagement of said engaging end of said jack with said hammer butt occurs before said hammer head reaches said at-rest position and such that said hammer assembly rests on said jack in said at-rest position, whereby, when said playing end of said key is released after play, said backcheck block begins to move away from said backstop assembly allowing return movement of said head toward said at-rest position, whereupon, said first, second, third and fourth torques act upon said hammer assembly such that re-engagement of said jack with said hammer butt occurs before said hammer head reaches said at-rest position, said re-engagement enabling replay, if said playing end of said key is again depressed, said re-engagement also reducing said third and fourth torques to enable said second torque to urge contact between said engaging end of said jack and said hammer butt and to enable said first torque to put said action in said at-rest position due to said net return force, and said re-engagement also assuring that said hammer assembly rests on said jack.

2. The action of claim 1 further comprising means for adjusting the value of said first torque.

3. The action of claim 1 further comprising means for adjusting the value of said third force due to said repetition spring.

4. The action of claim 1 in which said playing end of said key is longer than said working end.

* * * * *